US005400917A

United States Patent [19]

Stanton

[11] Patent Number: 5,400,917

[45] Date of Patent: Mar. 28, 1995

[54] BOX CONSTRUCTION AND METHOD

[76] Inventor: Steven W. Stanton, 3602 Grand Canal, Marina del Rey, Calif. 90292

[21] Appl. No.: 176,008

[22] Filed: Dec. 30, 1993

Related U.S. Application Data

[63] Continuation of Ser. No. 923,716, Jul. 31, 1992, abandoned.

[51] Int. Cl.[6] ..... B65D 3/10

[52] U.S. Cl. ..... 220/612; 220/626; 229/5.5; 229/23 A

[58] Field of Search ..... 220/612, 613, 626, 359, 220/355; 229/23 A, 8, 5.5; 206/822

[56] References Cited

U.S. PATENT DOCUMENTS

| | | | |
|---|---|---|---|
| 1,039,796 | 10/1912 | Phin | 220/626 |
| 1,364,640 | 1/1921 | Platz | 220/626 |
| 1,568,608 | 1/1926 | Klein | 229/8 |
| 2,034,358 | 3/1936 | Schleicher | 229/8 |
| 2,115,745 | 5/1938 | Page | 229/23 A |
| 2,119,360 | 5/1938 | Schleicher | 229/8 |
| 2,154,214 | 4/1939 | Roach et al. | 229/5.5 |
| 2,261,621 | 11/1941 | Harrison | 229/5.5 |
| 2,328,579 | 9/1943 | Pelosi | 229/5.5 |
| 2,337,416 | 12/1943 | Rosen | 229/8 |
| 2.423,965 | 7/1947 | Coyle | 220/612 |
| 2,642,911 | 6/1953 | DeShazor, Jr. | 220/612 |
| 2,950,849 | 8/1960 | Ortleb | 229/8 |
| 3,016,178 | 1/1962 | Knocks | 229/8 |
| 3,296,802 | 1/1967 | Williams | 220/613 |
| 3,346,170 | 10/1967 | Corter | 229/5.5 |
| 3,556,383 | 1/1971 | Glasband | 229/5.5 |
| 3,797,727 | 3/1974 | Downing et al. | 229/23 A |
| 4,117,971 | 10/1978 | Itoh | 220/612 |
| 4,418,834 | 12/1983 | Helms et al. | 220/359 |
| 4,892,214 | 1/1990 | Hamaguchi et al. | 220/612 |

FOREIGN PATENT DOCUMENTS

| | | | |
|---|---|---|---|
| 3935548 | 5/1991 | Germany | 220/359 |
| 124544 | 5/1991 | Japan | 229/8 |

*Primary Examiner*—S. Castellano
*Attorney, Agent, or Firm*—Lawrence S. Cohen

[57] ABSTRACT

A closure assembly is disclosed in which a first layer matches a side element in shape, and a spacer is fitted to establish a space for containing glue.

14 Claims, 5 Drawing Sheets

FIG 10
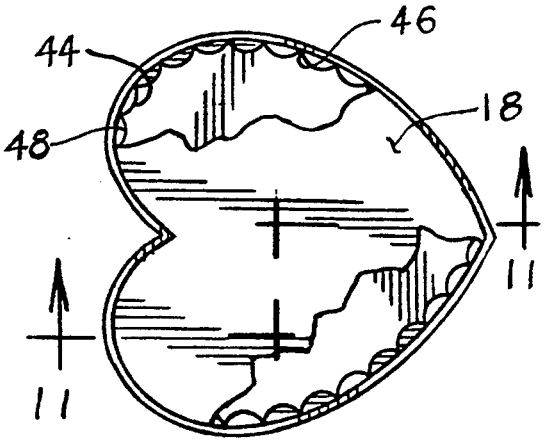
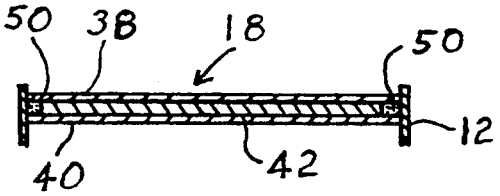
FIG 11
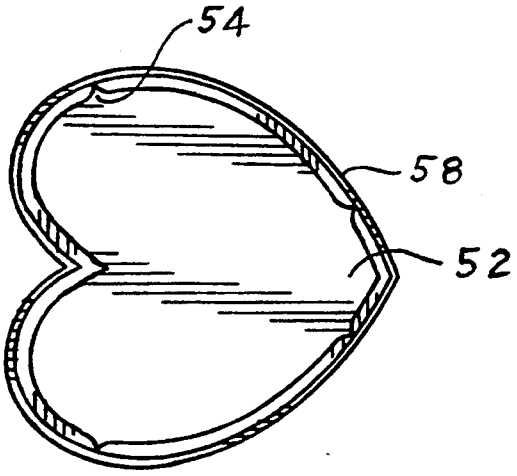
FIG 12

BOX CONSTRUCTION AND METHOD

This is a continuation of application Ser. No. 07/923,716, filed on Jul. 3, 1991, now abandoned.

BACKGROUND

This invention relates to decorative boxes in particular to a decorative box and a method of making a decorative box of the type made from paper products.

Typically such decorative boxes are made of a paper board material and are covered with decorative paper. They are formed with bends, corners and curves and have bottoms, sides and covers. Covers when used may be fully removable or hinged in some manner such as by a paper hinge. The boxes vary in durability and purpose; the strength of the materials and the construction method used varies depending on the desired durability and purpose. To form corners, the structural element may be scored and bent. Usually the ends of a continuous side element will meet at a place where there is to be a corner or sharp turn in the shape. To form curves the structural element is bent.

Typically the structural elements will be glued together; although it is also possible to join the elements by means of a decorative paper cover element extending from one structural element to the other. Sometimes both means are used, together.

In a large box of this type, greater strength is needed in joining the structural elements such as the side element and the bottom element together. Also, some box shapes have portions of the side element bent inwardly convexly or concavely to form the shape. This bending inwardly creates a tendency to straighten, that is to unbend. Therefore, there is a need to have a construction and method which will strongly hold all the parts together against the tendency to straighten.

SUMMARY OF THE INVENTION

The structure of the invention is the construction of a box made from paper board which has a side element and a bottom element in which the bottom element is formed of at least two layers, one of the layers being a spacer which is smaller than the other layer the latter being a bottom element, so that the spacer defines a peripheral space between the spacer and the side element. In the peripheral space glue can be placed such that the glue adheres to the side element, to the bottom element and to the spacer. This allows a greater volume of glue, and greater area of glue contact between the side element surface and the bottom element surface. An additional layer, an interior element, is usually added to cover the spacer on the interior of the box.

The method of the invention involves forming a side shape from a side element, forming a glue space by placing a peripherally smaller spacer onto a bottom member; inserting glue into the space and allowing the glue to cure thereby forming the container.

The invention will be described in a specific embodiment of a heart-shaped box made of paper products.

Appreciation of making a box from two basic geometric shapes are helpful to appreciate this technology. First is the circle. In a circular container the side element encloses the maximum possible area. The side element will be held together by a paper covering. A closure element such as a bottom is inserted into the circular space, and retained by a normal gluing construction, that is glue contacting the edge of the closure element and where it touches the side element.

The second basic shape is the square, rectangle or multilateral shape of the side element. Corners are formed by bending at a score. In this case too the bottom element can be fit and glued.

These two basic shapes tend to hold together relatively easily due to the fact that the side element has little or no force tending to cause it to expand away from the closure element; in the case of the circle because it encloses the largest possible area and in case of multilateral side elements because the flat sides and corner scores have little tendency to open.

Of course the present invention can also be applied to shapes such as a circle or curvature or to multilateral sides when greater structural integrity is desired. But, the most important use of the invention is when there is a sharp inward curvature either convex or concave of the side element where there is present a restoring tendency. The heart shape is an example of this type of convex structure. Concave curves are also examples of this type of structure.

BRIEF DESCRIPTION OF THE DRAWINGS

FIG. 10 is a partially broken away view looking into the box assembly at the bottom closure assembly.

FIG. 11 is the section through 11—11 of FIG. 10.

FIG. 12 is an alternative embodiment of the spacer.

DETAILED DESCRIPTION

Figure 1:
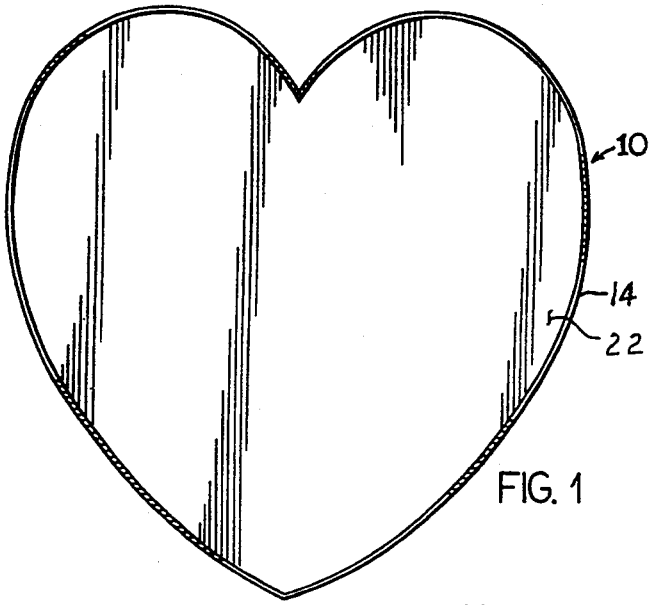
FIG. 1 is a top view of a heart shaped box.
Figure 3:
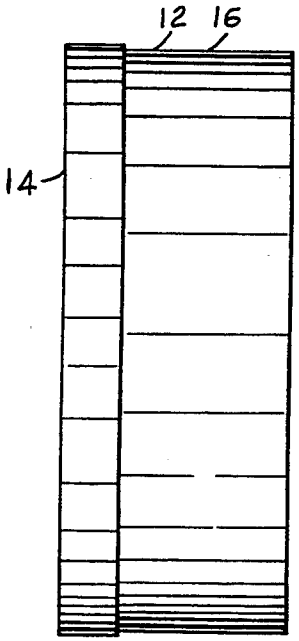
FIG. 3 is a side view of the box of FIG. 1.
Figure 2:
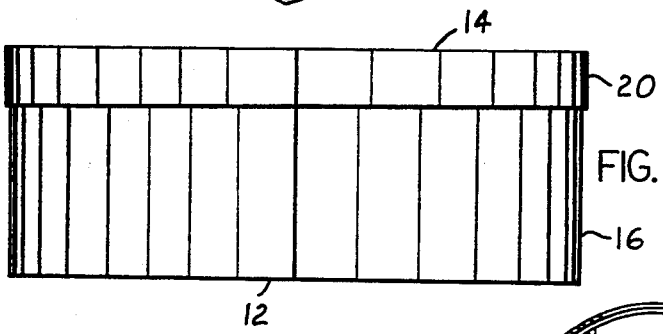
FIG. 2 is a front view of the box of FIG. 1.
Figure 4:
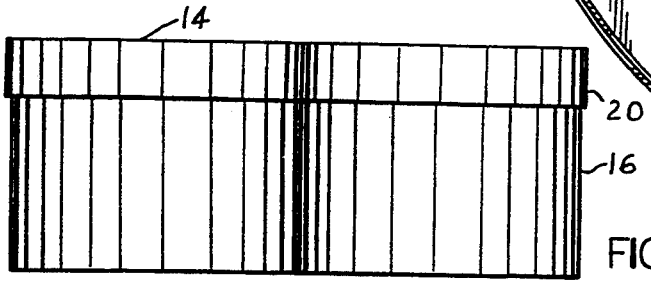
FIG. 4 is a rear view of the box of FIG. 1.
Figure 5:
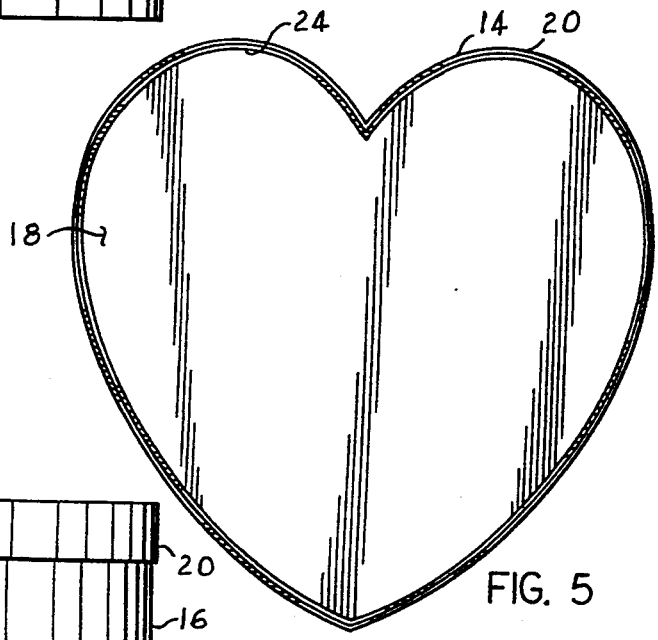
FIG. 5 is a bottom view of the box of FIG. 1.
Figure 6:
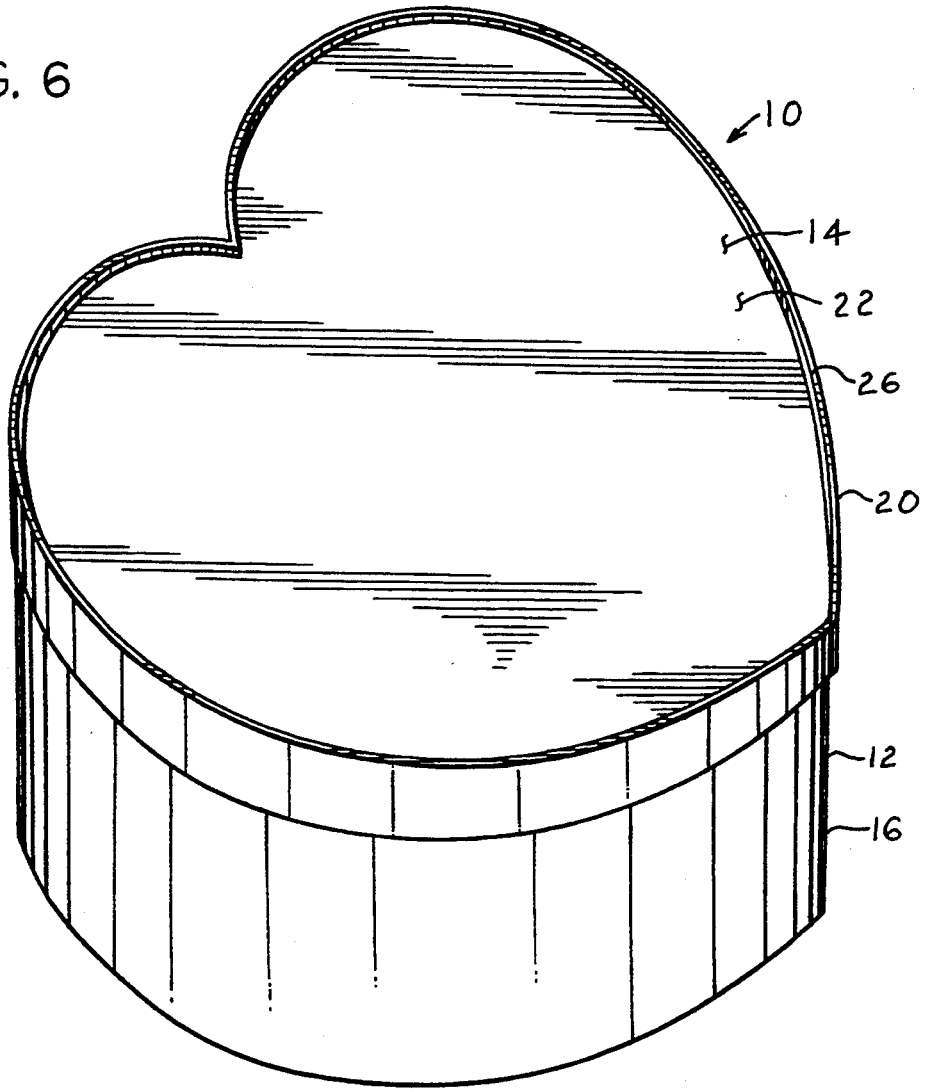
FIG. 6 is a perspective view of the box of FIGS. 1–5, looking down from above.
Figure 7:
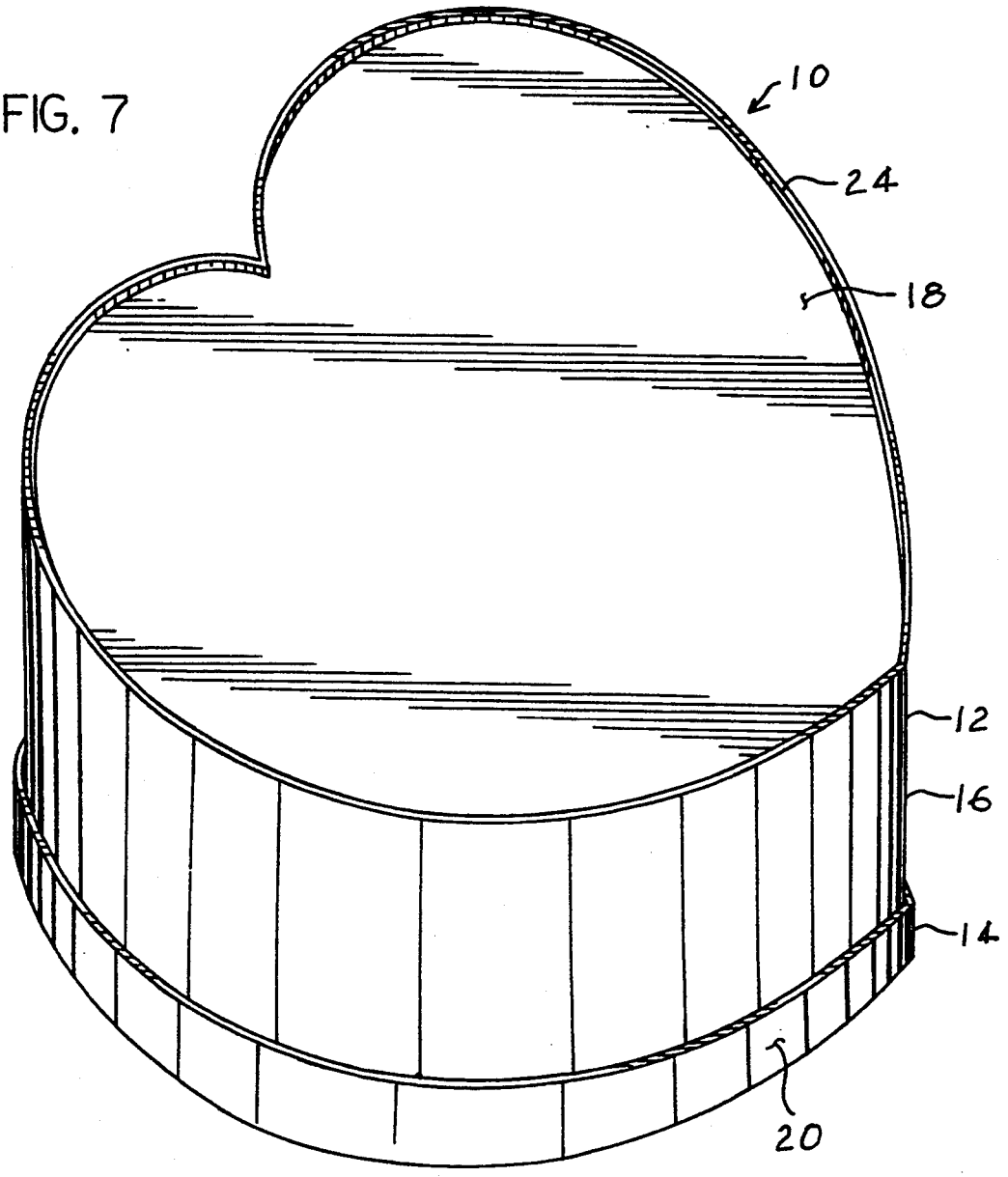
FIG. 7 is a perspective view of the box of FIGS. 1–5, looking up from below.

FIGS. 1–7 show a heart shaped box 10 which is made according to the construction and method of this invention. The box 10 has a box assembly 12 and a cover assembly 14. The box assembly 12 comprises a side element 16 and a bottom closure assembly 18. The cover assembly 14 has a cover side element 20 and a top closure assembly 22.

In constructing the box assembly 12, the bottom closure assembly 18 is recessed slightly into the side element 16 to form a bottom ridge 24. Similarly the top closure assembly 22 of the cover assembly 14 is recessed slightly to form a similar cover ridge 26. The externally seen parts of the box 10 can be described with reference to FIGS. 1–6.

In this description reference is not made to the decorative paper covering which is glued over the various elements because application of the paper covering is well known and is not relevant to the construction and method of the invention.

Figure 9:
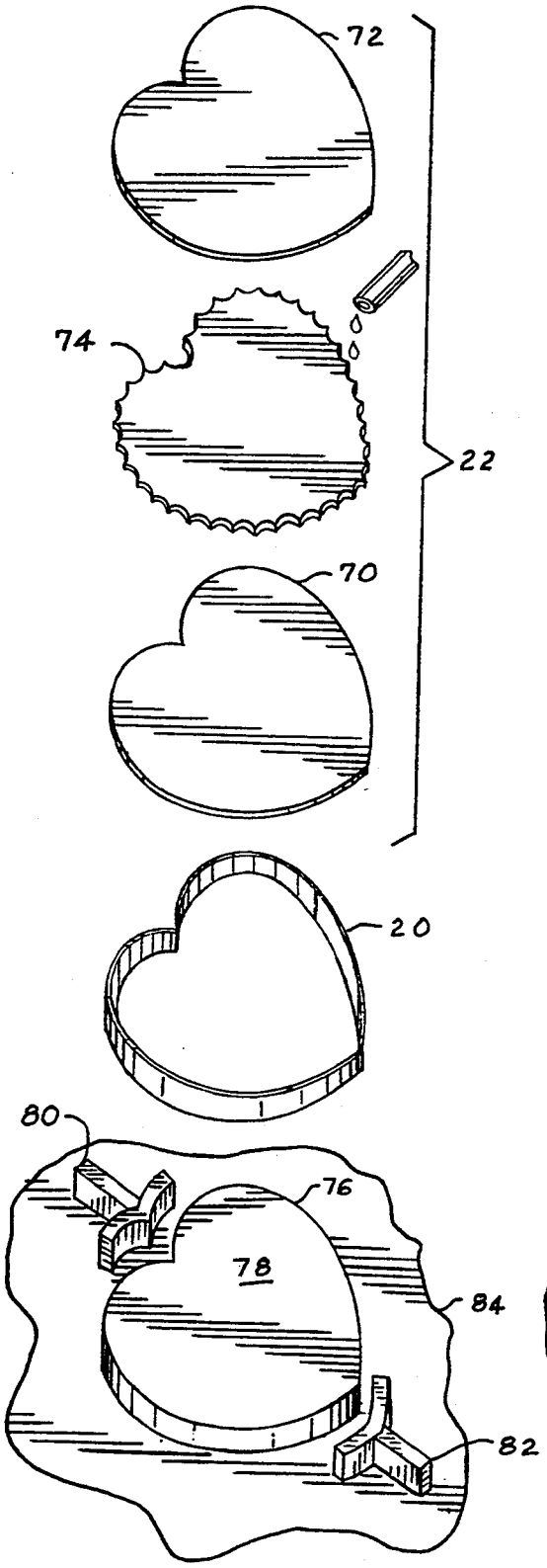
FIG. 9 is an expanded view of the cover assembly showing also the forming die and the order of assembly of parts.
Figure 8:
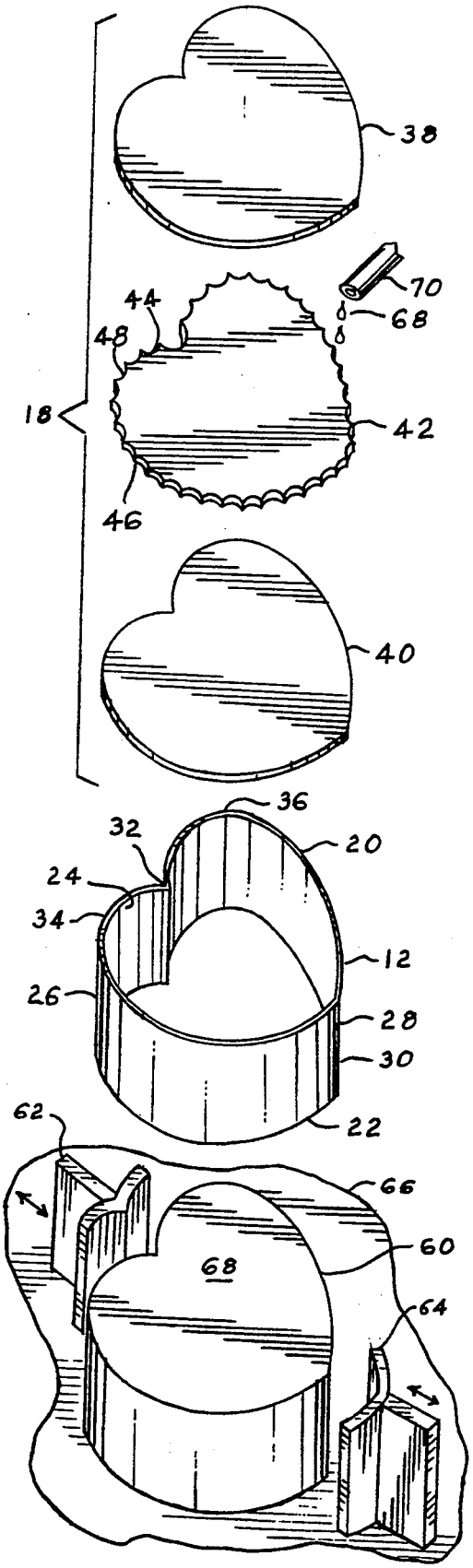
FIG. 8 is an expanded view of the box assembly showing also the forming die and the order of assembly of parts.

FIG. 8 is an exploded view of the construction of the box assembly 12. FIG. 9 is an exploded view of the cover assembly 14.

FIG. 10 shows a broken away view which shows either looking into the box assembly 12 or the cover assembly 14. FIG. 10 is a section through 10–10 of FIG. 10. FIG. 12 shows an alternative construction.

Referring to FIG. 8 the side element 12 has an upper edge 20, a lower edge 22, an inner surface 24 and an outer surface 26. It is discrete in length having a first end 28 and a second end 30. The side element 12 is formed into a heart shape and therefore has a score 32 at the joinder of the heart lobes 34 and 36. The ends 28 and 30 of the heart meet at the heart point. This could be reversed, with the ends joining at the middle of the heart lobes, and the scope at the point of the heart.

The flexibility of the board material allows the side element 12 to be bent into the convex curve of the heart shape without "breaking" the board, by breaking is meant a bend which causes a permanent distortion in the board fibers to the extent that resiliency is substantially lost and an abrupt bend can be seen rather than the intended smooth curve. Of course when working with a paper product, any bend can cause fiber distortion so that the element will not fully return to its original flat shape. Such limited distortion is desirable so that the restoring force is reduced, but still there is usually some tendency for a bent shape to open. The lobes 34, 36 of the heart shape have such a tendency to open.

The bottom closure assembly 18 in accordance with the invention is an assembly formed of three main portions; but as will be seen only two are essential to the structural purpose of this invention. These main portions are, an exterior layer 38, an interior layer 40, and a spacer 42.

The exterior layer 38 and the interior layer 40 are formed to fit precisely to the inner surface 24 of the heart shape of side element 12.

The spacer 42 is of generally the same shape as the exterior layer 38 and the interior layer 40, but smaller.

In this embodiment the spacer 42 is made with a series of scallops 44 around its periphery so that the points 46 of the scallops define a periphery which is the same size as the exterior layer 38 and which are designed to touch the interior surface 24, the bottom 48 of the scallops define a smaller periphery which is spaced away from interior surface 24. Thus, the points 46 serve to locate the spacer 42 correctly inside the side element 12.

Referring to FIG. 10, when the bottom closure assembly 18 is assembled, the points 46 of the scallops 44 will locate the spacer 42 inside the side element 12. This will leave a space, or in this case a series of spaces, which can receive glue. Consequently, as seen in FIG. 11, when the bottom closure assembly 18 is completed and assembled to the side element 12, there is formed the layered assembly of the exterior layer 38, the interior layer 40, with the spacer 42 between them. Glue 50 having been placed into the glue space formed by the scallops 44, now can form an adhesion to the side element 12 which is at least as thick as the spacer 42. It also forms a four-way adhesion of the side element 12, the exterior layer 38, the interior layer 40, and the spacer 42. Of course the glue will flow somewhat, which is desirable, but the amount of glue must be controlled so that it doesn't flow sufficiently to be seen after the box is constructed.

The spacer 42 can be made of a selected thickness of board material. Corrugated board is preferred as the channels formed by the corrugations accept flow of glue for added strength and due to enhanced rigidity given by the corrugated construction.

An alternative embodiment is shown in FIG. 12. In this embodiment the spacer 52 has only 4 locating points 54, leaving elongated spaces 56 for receiving glue between the spacer 52 and the side element 58.

This particular box embodiment is formed to have a ridge 24 on the bottom and a ridge 26 on the cover. The ridge 26 is formed by having the exterior layer 38 of the closure assembly 14 being slightly inside the side element 12, instead of being flush, so that the ridge 26 extends below the exterior layer 38. The ridge 24 is similarly formed.

For decorative purposes, decorated paper or plastic or fabric is used to cover the various elements. The decorative outer layer is applied in a manner known in the art.

The cover assembly 14 can be assembled in the same manner and with the same general construction elements as the box body. Alternatively, due to there being less restoring tendency for the cover side elements 20; it may not be necessary to use a spacer; edge gluing may be sufficient.

The method of making the heart shaped box is now described.

Referring to FIG. 8, the method of forming the box is described. Normally the piece parts to be assembled will be produced in separate operations to provide a supply for assembly. It is of no consequence when or in what order the piece parts are formed.

Assembly of the box body is facilitated by use of forming die 60 which is the shape of the interior space of the box, and holding die 62 and 64 which are mechanically moveable from a position spaced away form the forming die 60 to a holding position close to the forming die 60.

The side element 12 has been prepared by cutting to shape, scoring and covering with decorative cover. It is then placed over the forming die 60 to rest against table 66. It can appreciate that to form the box; the side element 12 must extend above the forming die 60 sufficiently to receive the elements 40, 42, and 38 of the bottom closure assembly 18.

Next the interior layer 40 is placed on the top surface 68 of the forming die 60. At this point the holding die 62 and 64 are brought into place sufficiently to keep the side element 12 in shaped position and to allow the various layers of the bottom closure assembly 18 not be fitted correctly, but easily. Then the spacer 42 is placed on the interior element 40. If properly made the interior closure layer 40 will contact the side element 12 around its entire periphery.

The tips 46 will locate the spacer 42 in the box opening, and the scallops 44 will be ready to receive glue in the glue spaces.

Then a hot melt glue 68 is applied with a glue dispensing device 70. A full bead of glue all around is desired. By experience the proper amount of glue can be applied to fill the glue spaces and run slightly into the corrugations of the spacer 42 as well as flowing between the layers of the closure assembly, but, without leaking to any portion of the box that can be seen.

Then the exterior layer 38 is placed over the spacer 42, pressed slightly to spread the glue, and the holding dies 62 and 64 are brought into a more firm holding position, while the hot melt glue cures.

The cover side 20 will be joined to the top closure assembly 22 which comprises an interior layer 70, an exterior layer 72 and a spacer 74. These elements of the top closure assembly 22 are proportioned to inter-fit and to fit into the cover side 20, in the same manner as previously described for the bottom closure assembly 18.

FIG. 9 shows the equivalent expanded view for assembly of the cover assembly 14. Therefore, a strong structure results due to the spacer 42 and the glue spaces enabling the presentation to the glue 50 of relatively large surfaces of the parts to be held together. Similarly the method of assembly of the cover assembly 14 and the top closure assembly 22 is the same as for the box assembly 12 and the bottom closure assembly 18 so it will not be exhaustively repeated here. In this case, a forming die 76, has a top surface 78 and is accompanied by holding die 80 and 82 on a table 84.

FIGS. 11 and 12 can be equally applicable to either the bottom closure assembly 18 as explained above or the top closure assembly 22.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A container comprising;

at least one side element defining an interior shape;

a closure assembly for said side element defining a closure for said container;

said closure assembly comprising;

a first layer peripherally shaped to substantially match the interior shape of the side element;

a spacer adjacent the first layer, the spacer having a periphery conforming generally to the interior shape but having a substantial portion of its periphery being spaced away from the side element to define at least one space bounded by the periphery of the spacer, the side element and the first layer;

the spacer having at least one extension extending from its spaced periphery to the side element in order to locate the spacer within the side element; and glue contained in a substantial portion of said at least one space to adhere the closure assembly to the side element and forming at least one glue mass having adhesion areas to the side element, the first layer and the spacer to structurally form said container.

2. The container of claim 1 wherein said at least one extension comprises a plurality of extensions extending from the spaced periphery of the spacer to the side element in order to locate the spacer within the side element.

3. A container comprising;

at least one side element made from thin board stock defining an interior shape;

a closure assembly of said side element defining a closure for said container;

said closure assembly comprising;

a first layer having a peripheral edge shaped to substantially match the interior shape of the side element, said first layer having a face surface and said first layer being positioned wholly inside said interior shape of said side element and forming a closure of the side element interior shape: and a spacer formed of a separate layer adjacently overlying said face surface of the first layer, the spacer having a peripheral edge conforming generally to the interior shape of said side element but having a substantial portion of its peripheral edge being spaced away from the side element and the peripheral edge of said first layer leaving a peripheral portion of said face surface substantially uncovered by said spacer to define at least one space bounded by the peripheral edge of the spacer, the side element and said peripheral portion of said face surface of the first layer;

glue contained in a substantial portion of said at least one space to adhere the closure assembly to the side element and forming at least one glue mass having adhesion areas to the side element, the first layer and the spacer to structurally form said container; and absent any integral supporting element formed as part of the side element on which the closure assembly is supported.

4. The container of claim 3 further comprising a second layer peripherally shaped to substantially match the interior shape of the side element and wherein the spacer is between the first and second layers and said at least one space is bounded by the peripheral edge of the spacer, the side element, the first layer and the second layer.

5. The container of claim 3;

wherein the spacer has a plurality of extensions extending from said substantial portion of its peripheral edge which is spaced away from the side element in order to locate the spacer in the side element.

6. The container of claim 3;

wherein the spacer has at least one extension extending from said substantial portion of its peripheral edge which is spaced away from the side element in order to locate the spacer.

7. The container of claim 3; wherein the side element, the first layer, and the spacer are made of a paper product.

8. The container of claim 7 said container further comprising a covering over said side element.

9. The container of claim 8 wherein said container further comprises a cover member.

10. The container of claim 3 wherein said side element is shaped to define a containment volume less than the maximum volume available from the overall length of the side element.

11. The container of claim 3 wherein said side element is shaped to have bent portions to form a shape smaller in area than a circle formable therefrom.

12. The container of claim 7 wherein said side element is shaped to have bent portions to form a shape smaller in area than a circle formed therefrom.

13. The container of claim 12 wherein said side element has at least one score defining at least two lengths, and at least one of said lengths is bent to form said shape.

14. The container of claim 12 wherein said side element is shaped to form a heart shape.

* * * * *